US006341388B1

(12) United States Patent
Roberts

(10) Patent No.: US 6,341,388 B1
(45) Date of Patent: Jan. 29, 2002

(54) BATHTUB SPLASH GUARD ASSEMBLY

(76) Inventor: Lee J. Roberts, 16 Martin Close, Rainhill, Liverpool, Merseyside L35 8LX (GB)

( * ) Notice: Subject to any disclaimer, the term of this patent is extended or adjusted under 35 U.S.C. 154(b) by 0 days.

(21) Appl. No.: 09/648,234

(22) Filed: Aug. 25, 2000

(51) Int. Cl.[7] ..... A47K 3/00
(52) U.S. Cl. ..... 4/609
(58) Field of Search ..... 4/300.3, 558, 608, 4/609, 655, 657, DIG. 18

(56) References Cited

U.S. PATENT DOCUMENTS

| | | | | | |
|---|---|---|---|---|---|
| 1,013,162 | A | | 1/1912 | Hiteshew | |
| 1,159,507 | A | * | 11/1915 | Lang | 4/608 X |
| 1,791,696 | A | | 2/1931 | Alexander | |
| 2,131,156 | A | * | 9/1938 | Yardley | 4/558 |
| 3,321,781 | A | * | 5/1967 | Reich | 4/608 |
| 3,382,507 | A | * | 5/1968 | Micheau | 4/558 |
| 3,938,200 | A | * | 2/1976 | Roberts et al. | 4/DIG. 18 |
| D271,516 | S | | 11/1983 | Dose et al. | |
| 5,231,707 | A | | 8/1993 | Ashley et al. | |
| 5,249,315 | A | | 10/1993 | Moylan | |
| 5,365,619 | A | | 11/1994 | Solomon | |

* cited by examiner

*Primary Examiner*—Robert M. Fetsuga

(57) ABSTRACT

A bathtub splash guard assembly for keeping water inside the bathtub includes a sheet member with a plurality of substantially rigid rod members. Each rod member is coupled to the sheet member in spaced relationship to each other. In addition there is a plurality of sheet connection members coupled along a bottom edge of the sheet member. The sheet member is adapted for coupling to a bathtub wall so that the rod members hold the sheet member in a generally upright position for preventing water in the bathtub from splashing over an edge of the bathtub.

9 Claims, 2 Drawing Sheets

BATHTUB SPLASH GUARD ASSEMBLY

BACKGROUND OF THE INVENTION

1. Field of the Invention

The present invention relates to bathtub splash shields and more particularly pertains to a new bathtub splash guard assembly for keeping water inside the bathtub.

2. Description of the Prior Art

The use of bathtub splash shields is known in the prior art. More specifically, bathtub splash shields heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,249,315; 1,791,696; 5,365,619; 5,231,707; Des. 271,516; and 1,013,162.

While these devices fulfill their respective, particular objectives and requirements, the aforementioned patents do not disclose a new bathtub splash guard assembly. The inventive device includes a sheet member with a plurality of substantially rigid rod members. Each rod member is coupled to the sheet member in spaced relationship to each other. In addition there is a plurality of sheet connection members coupled along a bottom edge of the sheet member. The sheet member is adapted for coupling to a bathtub wall so that the rod members hold the sheet member in a generally upright position for preventing water in the bathtub from splashing over an edge of the bathtub.

In these respects, the bathtub splash guard assembly according to the present invention substantially departs from the conventional concepts and designs of the prior art, and in so doing provides an apparatus primarily developed for the purpose of keeping water inside the bathtub.

SUMMARY OF THE INVENTION

In view of the foregoing disadvantages inherent in the known types of bathtub splash shields now present in the prior art, the present invention provides a new bathtub splash guard assembly construction wherein the same can be utilized for keeping water inside the bathtub.

The general purpose of the present invention, which will be described subsequently in greater detail, is to provide a new bathtub splash guard assembly apparatus and method which has many of the advantages of the bathtub splash shields mentioned heretofore and many novel features that result in a new bathtub splash guard assembly which is not anticipated, rendered obvious, suggested, or even implied by any of the prior art bathtub splash shields, either alone or in any combination thereof.

To attain this, the present invention generally comprises of a sheet member with a plurality of substantially rigid rod members. Each rod member is coupled to the sheet member in spaced relationship to each other. In addition there is a plurality of sheet connection members coupled along a bottom edge of the sheet member. The sheet member is adapted for coupling to a bathtub wall so that the rod members hold the sheet member in a generally upright position for preventing water in the bathtub from splashing over an edge of the bathtub.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bathtub splash guard assembly apparatus and method which has many of the advantages of the bathtub splash shields mentioned heretofore and many novel features that result in a new bathtub splash guard assembly which is not anticipated, rendered obvious, suggested, or even implied by any of the prior art bathtub splash shields, either alone or in any combination thereof.

It is another object of the present invention to provide a new bathtub splash guard assembly which may be easily and efficiently manufactured and marketed.

It is a further object of the present invention to provide a new bathtub splash guard assembly which is of a durable and reliable construction.

An even further object of the present invention is to provide a new bathtub splash guard assembly which is susceptible of a low cost of manufacture with regard to both materials and labor, and which accordingly is then susceptible of low prices of sale to the consuming public, thereby making such bathtub splash guard assembly economically available to the buying public.

Still yet another object of the present invention is to provide a new bathtub splash guard assembly which provides in the apparatuses and methods of the prior art some of the advantages thereof, while simultaneously overcoming some of the disadvantages normally associated therewith.

Still another object of the present invention is to provide a new bathtub splash guard assembly for keeping water inside the bathtub.

Yet another object of the present invention is to provide a new bathtub splash guard assembly which includes a sheet member with a plurality of substantially rigid rod members. Each rod member is coupled to the sheet member in spaced relationship to each other. In addition there is a plurality of sheet connection members coupled along a bottom edge of the sheet member. The sheet member is adapted for coupling to a bathtub wall so that the rod members hold the sheet member in a generally upright position for preventing water in the bathtub from splashing over an edge of the bathtub.

Still yet another object of the present invention is to provide a new bathtub splash guard assembly that is retrofittable to existing bathtubs.

Even still another object of the present invention is to provide a new bathtub splash guard assembly that can be rolled for storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
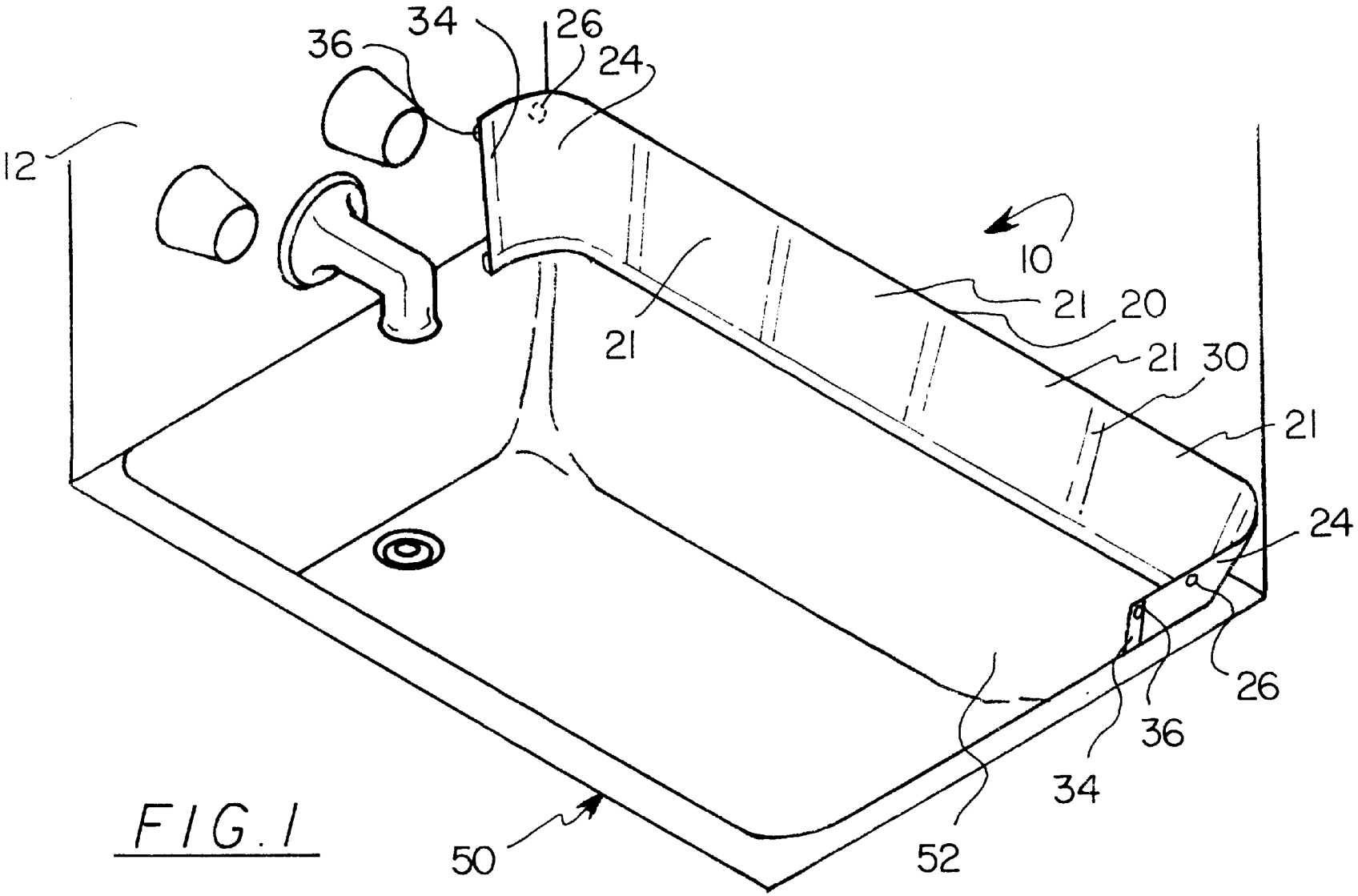
FIG. 1 is a perspective view of a new bathtub splash guard assembly according to the present invention.
Figure 2:
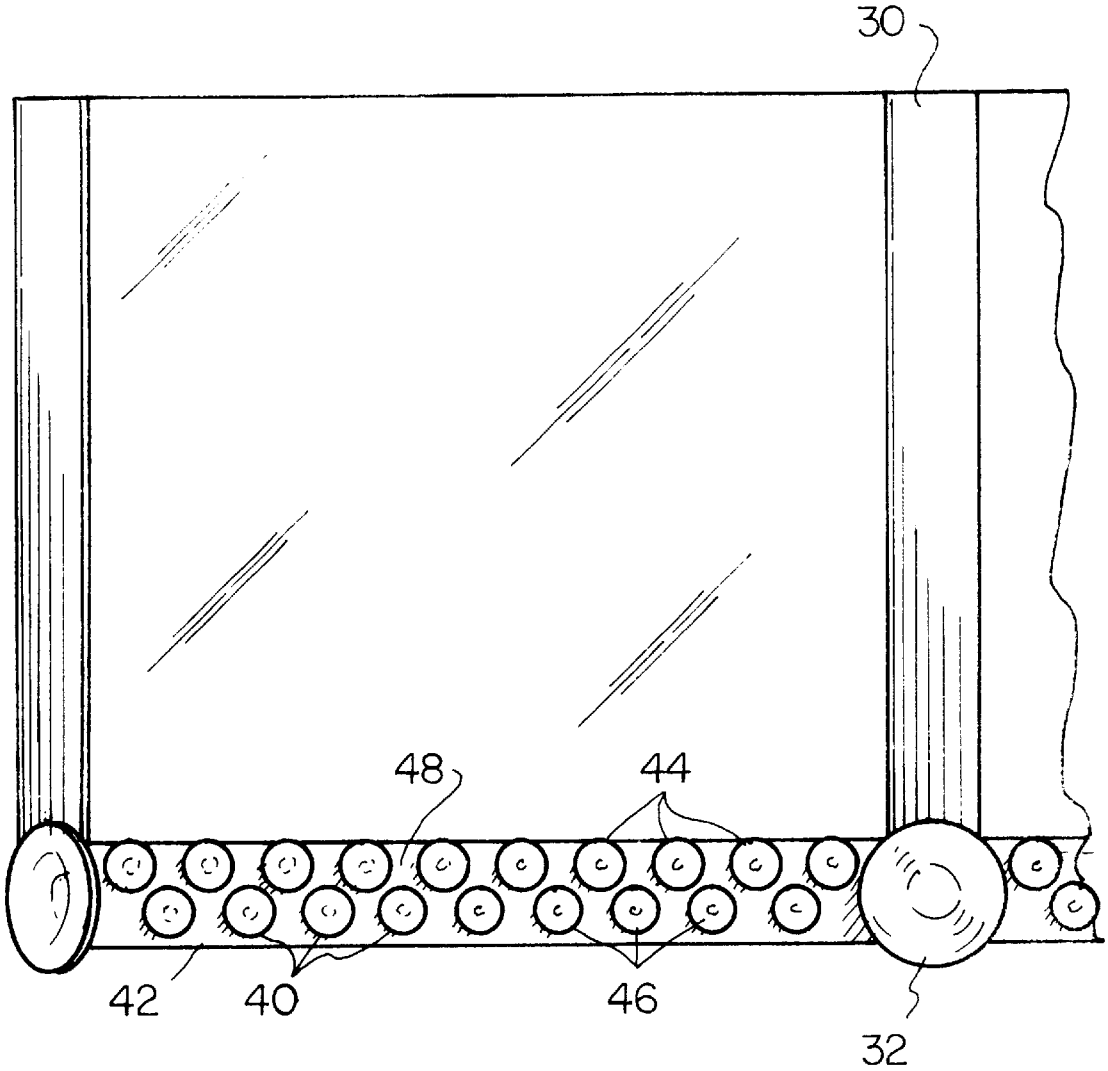
FIG. 2 is a rear view of the present invention.

With reference now to the drawings, and in particular to FIGS. 1 through 2 thereof, a new bathtub splash guard assembly embodying the principles and concepts of the present invention and generally designated by the reference numeral 10 will be described.

As best illustrated in FIGS. 1 through 2, the bathtub splash guard assembly 10 generally comprises a sheet member 20, a plurality of substantially rigid rod members 30, and a plurality of sheet connection members 40.

The substantially rigid rod members 30 are coupled to the sheet member 20 in spaced relationship to each other.

The sheet connection members 40 are coupled along a bottom edge 42 of the sheet member 20. The sheet member 20 is designed for coupling to a bathtub wall 52 such that the rod members 30 hold the sheet member 20 in a generally upright position for preventing water in the bathtub 50 from splashing over an edge 54 of the bathtub 50.

In an embodiment, the invention includes a plurality of rod suction cups 32. Each of the rod suction cups 32 is coupled to an associated one of the rod members 30 proximate a bottom of the associated rod member 30 for coupling the associated rod member 30 to the bathtub wall.

The plurality of sheet connection members 40 is arranged into an upper line 44 of the sheet connection members 40 and a lower line 46 of the sheet connection members 40. The lower line 44 of sheet connection members 40 is offset with respect to the upper line 44 of the sheet connection members 40. The center of each sheet connection member 40 in the lower line 46 of sheet connection members 40 is aligned with a gap 48 between an associated adjacently positioned pair of sheet connection members 40 in the upper line 44.

In an embodiment, each of the sheet connection members 40 is a suction cup. Each of the suction cups in the lower line 46 of sheet connection members 40 has a diameter greater than a width of the gap 48 between the associated adjacently positioned pair of sheet connection members 40 in the upper line 44 of sheet connection members 40. The arrangement for the suction cups is designed for the prevention of water passing through the gap 48 between the associated adjacently positioned pair of sheet connection members in the upper line 44 of sheet connection members 40.

The plurality of rod members 30 includes a pair of outer rod members 34. Each of the outer rod members 34 is coupled to an associated end of the sheet member 20. A plurality of upper rod suction cups 36 are provided. Each of the upper rod suction cups 36 is coupled to an associated one of the outer rod members 34 proximate an upper end of the associated outer rod member 34. The outer rod member 34 is designed for coupling the upper end of the outer rod member 34 to a wall 12 above the bathtub 50 for facilitating stable coupling of the sheet member 20 relative to the bathtub 50.

The rod members 30 are positioned to divide the sheet member 20 into a plurality of sections 21. Each section 21 extends between an associated adjacent pair of the rod members 30. The sections 21 include a pair of outermost sections 24. A plurality of upper sheet member suction cups 26 are provided. Each of the upper rod suction cups 26 are coupled to an associated one of the outermost sections 24 proximate an upper edge of the associated outermost section 24. The outermost section 24 is designed for coupling the upper edge of the outermost section 24 to the wall 12 above the bathtub 50 for facilitating stable coupling of the sheet member 20 relative to the bathtub 50.

The bottom edge of the sheet member 42 is reinforced for preventing tearing of the sheet member 20 during coupling and uncoupling of the sheet member 20.

In use, a user presses the upper sheet suction cup and the upper rod suction cup to the bathtub wall. Then, the user unrolls the splashguard along the edge of the bathtub while pressing the sheet connection members and rod suction cups to the bathtub edge. On the other end of the bathtub, the user presses the other upper sheet suction cup and upper rod suction cup to the bathtub wall.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bathtub splash guard assembly comprising:

a sheet member;

a plurality of substantially rigid rod members coupled to said sheet member in spaced relationship to each other;

a plurality of sheet connection members coupled along a bottom edge of said sheet member whereby said sheet member is adapted for coupling to a bathtub wall such that said rod members hold said sheet member in a generally upright position for preventing water in the bathtub from splashing over an edge of the bathtub;

said plurality of rod members including a pair of outer rod members, each of said outer rod members being coupled to an associated end of said sheet member;

a plurality of upper rod suction cups, each of said upper rod suction cups being coupled to an associated one of said outer rod members proximate an upper end of said associated outer rod member whereby each said outer rod member is adapted for coupling said upper end of said outer rod member to a wall above said bathtub for facilitating stable coupling of said sheet member relative to the bathtub.

2. The bathtub splash guard assembly of claim 1, further comprising:

a plurality of rod suction cups, each of said rod suction cups being coupled to an associated one of said rod members proximate a bottom of said associated rod member for coupling said associated rod member to the bathtub wall.

3. The bathtub splash guard assembly of claim 1, further comprising:

said plurality of sheet connection members being arranged into an upper line of said sheet connection members and a lower line of said sheet connection members, said lower line of sheet connection members being offset with respect to said upper line of said sheet connection members such that a center of each sheet connection member in said lower line of sheet connection members is aligned with a gap between an associated adjacently positioned pair of sheet connection members in said upper line of sheet connection members.

4. The bathtub splash guard assembly of claim 3, further comprising:

each of said sheet connection members being a suction cup, each of said suction cups in said lower line of sheet connection members having a diameter greater than a width of said gap between said associated adjacently positioned pair of sheet connection members in said upper line of sheet connection members for facilitating prevention of water passing unimpeded through both said upper line of sheet connection members and said lower line of sheet connection members.

5. A bathtub splash guard assembly comprising:

a sheet member;

a plurality of substantially rigid rod members coupled to said sheet member in spaced relationship to each other;

a plurality of sheet connection members coupled along a bottom edge of said sheet member whereby said sheet member is adapted for coupling to a bathtub wall such that said rod members hold said sheet member in a generally upright position for preventing water in the bathtub from splashing over an edge of the bathtub;

said rod members being positioned to divide said sheet member into a plurality of sections, each section extending between an associated adjacent pair of said rod members;

said sections including a pair of outermost sections;

a plurality of upper sheet member suction cups, each of said upper rod suction cups being coupled to an associated one of said outermost sections proximate an upper edge of said associated outermost section whereby each said outermost section is adapted for coupling said upper edge of said outermost section to a wall above said bathtub for facilitating stable coupling of said sheet member relative to the bathtub.

6. The bathtub splash guard assembly of claim 5, further comprising:

a plurality of rod suction cups, each of said rod suction cups being coupled to an associated one of said rod members proximate a bottom of said associated rod member for coupling said associated rod member to the bathtub wall.

7. The bathtub splash guard assembly of claim 5, further comprising:

said plurality of sheet connection members being arranged into an upper line of said sheet connection members and a lower line of said sheet connection members, said lower line of sheet connection members being offset with respect to said upper line of said sheet connection members such that a center of each sheet connection member in said lower line of sheet connection members is aligned with a gap between an associated adjacently positioned pair of sheet connection members in said upper line of sheet connection members.

8. The bathtub splash guard assembly of claim 7, further comprising:

each of said sheet connection members being a suction cup, each of said suction cups in said lower line of sheet connection members having a diameter greater than a width of said gap between said associated adjacently positioned pair of sheet connection members in said upper line of sheet connection members for facilitating prevention of water passing unimpeded through both said upper line of sheet connection members and said lower line of sheet connection members.

9. A bathtub splash guard assembly comprising:

a sheet member;

a plurality of substantially rigid rod members being coupled to said sheet member in spaced relationship to each other;

a plurality of sheet connection members coupled along a bottom edge of said sheet member whereby said sheet member is adapted for coupling to a bathtub wall such that said rod members hold said sheet member in a generally upright position for preventing water in the bathtub from splashing over an edge of the bathtub;

a plurality of rod suction cups, each of said rod suction cups being coupled to an associated one of said rod members proximate a bottom of said associated rod member for coupling said associated rod member to the bathtub wall;

said plurality of sheet connection members being arranged into an upper line of said sheet connection members and a lower line of said sheet connection members, said lower line of sheet connection members being offset with respect to said upper line of said sheet connection members such that a center of each sheet connection member in said lower line of sheet connection members is aligned with a gap between an associated adjacently positioned pair of sheet connection members in said upper line of sheet connection members;

each of said sheet connection members being a suction cup, each of said suction cups in said lower line of sheet connection members having a diameter greater than a width of said gap between said associated adjacently positioned pair of sheet connection members in said upper line of sheet connection members for facilitating prevention of water passing unimpeded through both said upper line of sheet connection members and said lower line of sheet connection members;

said plurality of rod members including a pair of outer rod members, each of said outer rod members being coupled to an associated end of said sheet member;

a plurality of upper rod suction cups, each of said upper rod suction cups being coupled to an associated one of said outer rod members proximate an upper end of said associated outer rod member whereby each said outer rod member is adapted for coupling said upper end of said outer rod member to a wall above the bathtub for facilitating stable coupling of said sheet member relative to the bathtub;

said rod members being positioned to divide said sheet member into a plurality of sections, each section extending between an associated adjacent pair of said rod members;

said sections including a pair of outermost sections; and a plurality of upper sheet member suction cups, each of said upper rod suction cups being coupled to an associated one of said outermost sections proximate an upper edge of said associated outermost section whereby each said outermost section is adapted for coupling said upper edge of said outermost section to the wall above the bathtub for facilitating stable coupling of said sheet member relative to the bathtub.

* * * * *